United States Patent [19]

Blue

[11] 4,028,921

[45] June 14, 1977

[54] TOOTH FORMING RACK WITH REPLACEABLE INSERTS

[75] Inventor: Donald E. Blue, Decatur, Ill.

[73] Assignee: Caterpillar Tractor Co., Peoria, Ill.

[22] Filed: Feb. 13, 1976

[21] Appl. No.: 657,773

[52] U.S. Cl. ..... 72/88; 72/469; 72/481

[51] Int. Cl.[2] ..... B21H 5/02

[58] Field of Search ..... 72/469, 88, 90, 478, 72/481

[56] References Cited

UNITED STATES PATENTS

| | | | |
|---|---|---|---|
| 2,161,610 | 6/1939 | Boggild | 72/90 |
| 3,019,677 | 2/1962 | Cermatori | 72/90 |
| 3,283,559 | 11/1966 | Clerk | 72/469 |
| 3,818,736 | 6/1974 | Blue | 72/88 |
| 3,910,099 | 10/1975 | Wilson | 72/88 |

*Primary Examiner*—Milton S. Mehr
*Attorney, Agent, or Firm*—Phillips, Moore, Weissenberger, Lempio & Majestic

[57] ABSTRACT

An improved tool in the form of a tooth forming rack for cold working a cylindrical workpiece to form teeth thereon to produce, for example, a toothed gear is provided. The rack comprises a plurality of releasable inserts mounted on a tool holder. The inserts are of the throw-away type which enables replacement of only that portion of the rack that is worn or broken, thus extending the ueful life of the entire rack. In a first embodiment the inserts are releasably attached to the tool holder by threaded capscrews. In an alternate embodiment a milled slot within the inserts permits retention by means of tapered retainers attached to the tool holder by threaded capscrews.

10 Claims, 7 Drawing Figures

TOOTH FORMING RACK WITH REPLACEABLE INSERTS

BACKGROUND OF THE INVENTION

This invention relates to tooth forming machines which displace metal through a cold forming process and are capable of producing the finished part more economically than traditional methods of removing metal, such as cutting. More particularly this invention is directed to an improved segmented rack for such machines which permits the removal of damaged tooth sections.

Typical cold rolling machines which form splines, serrations, and similar teeth by rolling a cylindrical workpiece between dies moving in opposite directions are described in U.S. Pat. Nos. 2,994,237 to H. Pelphrey; 2,995,964 to J.C. Drader; 3,015,243 to J.C. Drader and 3,818,964 to Blue. With these machines, pairs of elongated racks or dies are used to produce a particular part, and it is desirable that each set of racks normally produce several thousand supplied splines or the like before regrinding of the racks is required. Unfortunately, the severe work environment experienced by these racks results in excessive stress risers and accompanying a cracking of some of the teeth thereof through fatigue-type failures. Since these racks cost up several thousand dollars, failure are extremely costly. Furthermore, when these present racks fail, sufficient material must be removed for the entire length of the rack to get below the fatigue-affected zone. Following this, new teeth are ground on the full length of the rack.

Another problem with current racks is that the rack is made of relatively costly tool steel and requires many pounds of this relatively expensive material. For example, present racks use 165–375 lbs. of tool steel for a 36 inch rack and 275–450 lbs. for a 48 inch rack.

Furthermore, to anticipate the breakage that will occur to the teeth of these current racks, a large number of racks must be maintained and stored. This storage requires a great deal of space and also ties-up capital.

Summary and Objects of the Invention

It is therefore the primary object of this invention to provide an improved segmented rack which allows the replacement of only a short portion of the rack when wear or tooth breakage occurs, thereby increasing the useful life of the balance of the rack.

It is a further object of this invention to provide such a rack that is comprised of an insert holder and a plurality of inserts are tooth sections.

It is a further object of this invention to provide such a rack wherein the inserts are of relatively hard material with respect to the insert holder.

The invention takes the form of a generally elongated insert holder and a plurality of inserts which are releasably attached to the top surface of the insert holder. The insert holder in turn is mountable on a tooth forming machine by means of flanges thereon secured by a plurality of bolts and brackets.

The inserts holders may be made of relatively inexpensive metal material such as carbon steel. The inserts themselves, on the other hand, are made of relatively expensive material such as tool steel. In this manner, the cost of the composite rack is reduced from that which would be expected when using entirely tool steel.

Futhermore, a plurality of insert sections are mountable on the insert holder in end-to-end relationship by means of cap screws which are inserted through the bottom of the insert holder and threadably engaged in the bottom of the inserts. The teeth on the inserts are ground so that adjoining inserts meet at the tooth root area.

In an alternate embodiment, the inserts are held by means of flanges fitted within an elongated slot within the base of the inserts. By having a plurality of replaceable inserts, only a single insert need be replaced when a tooth breaks. In addition, storage requirements are considerably reduced since a fewer number of insects would have to be required for contingency purposes than is the case with entire racks.

The inserts would be so inexpensive that they could be safely thrown away then reground. Thus, a great savings in terms of machining and grinding costs is encountered with this invention.

Guide flanges on the insert holder serve to maintain insert position under the forces encountered in the tooth forming operation.

Other objects and advantages of the present invention will become more readily apparent upon having reference to the accompanying drawings and the following description.

DETAILED DESCRIPTION

Figure 1:
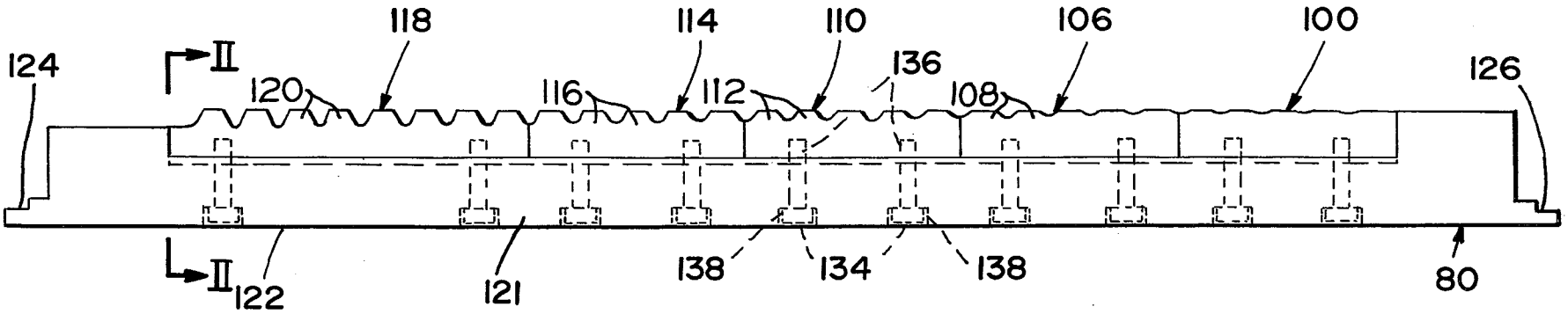
FIG. 1 is an enlarged front-elevation view of the insert holder of the instant invention with inserts mounted thereon.

FIG. 1 shows a single rack assembly of the instant invention which is used in conjunction with a tooth forming machine.

Figure 5:
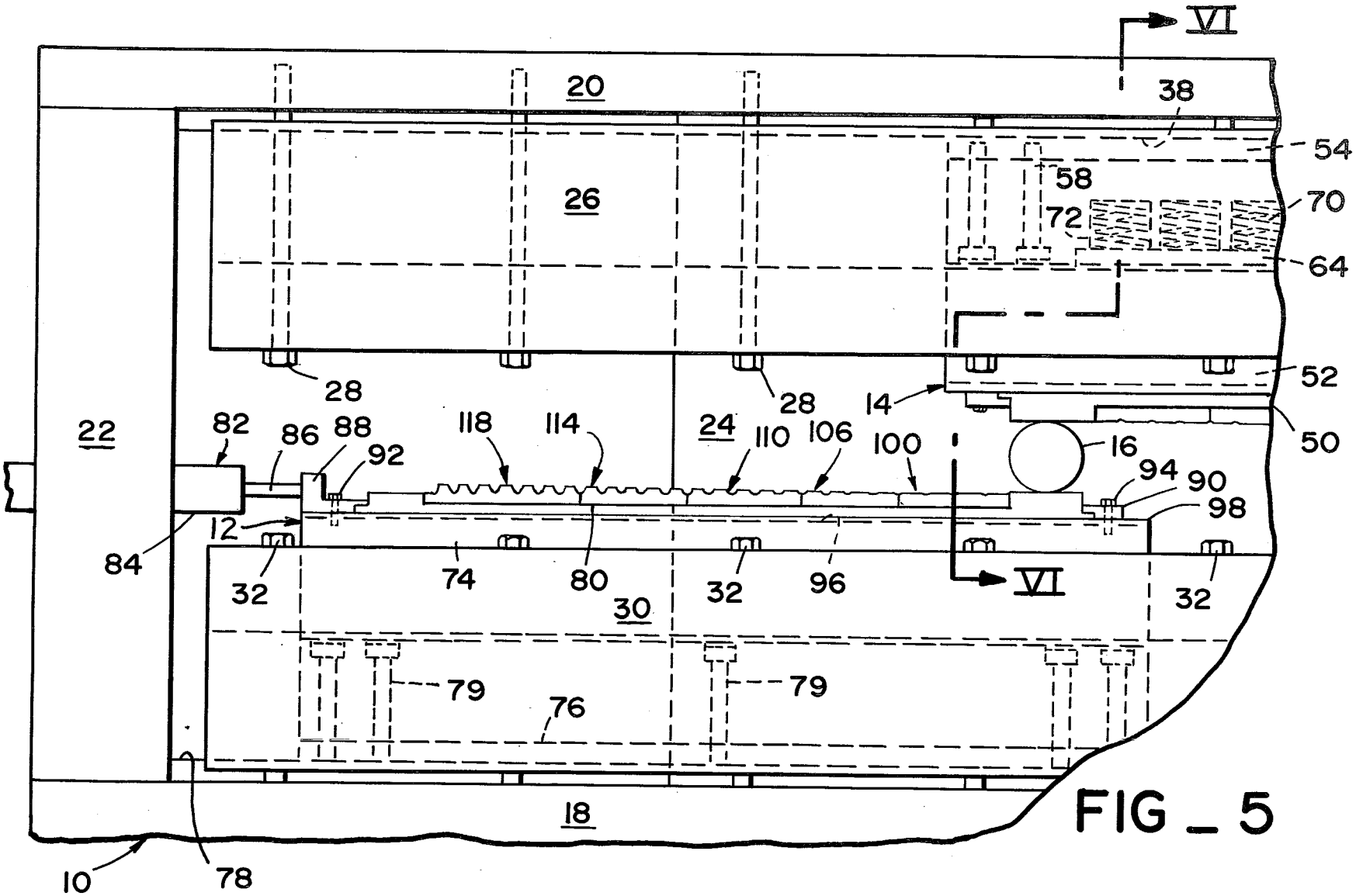
FIG. 5 is a side-elevational view of a tooth forming machine with the portions thereof removed for illustrative convenience.

Referring particularly to FIG. 5, a forming machine 10 includes a lower tool assembly 12 and an upper tool assembly 14 which are shown in an initial tangential gripping relationship with respect to a cylindrical workpiece 16. The tooth forming machine includes relatively heavy and rigid frame members comprising a lower bed plate 18, an upper bed plate 20, a pair of end walls 22 and a pair of side frames 24, only one of each of these pairs being shown. The cylindrical workpiece is rotatably supported on stationary locating centers or suitable cradles (not shown) which are adjustably mounted on the side frames 24 of the tooth forming machine.

Figure 6:
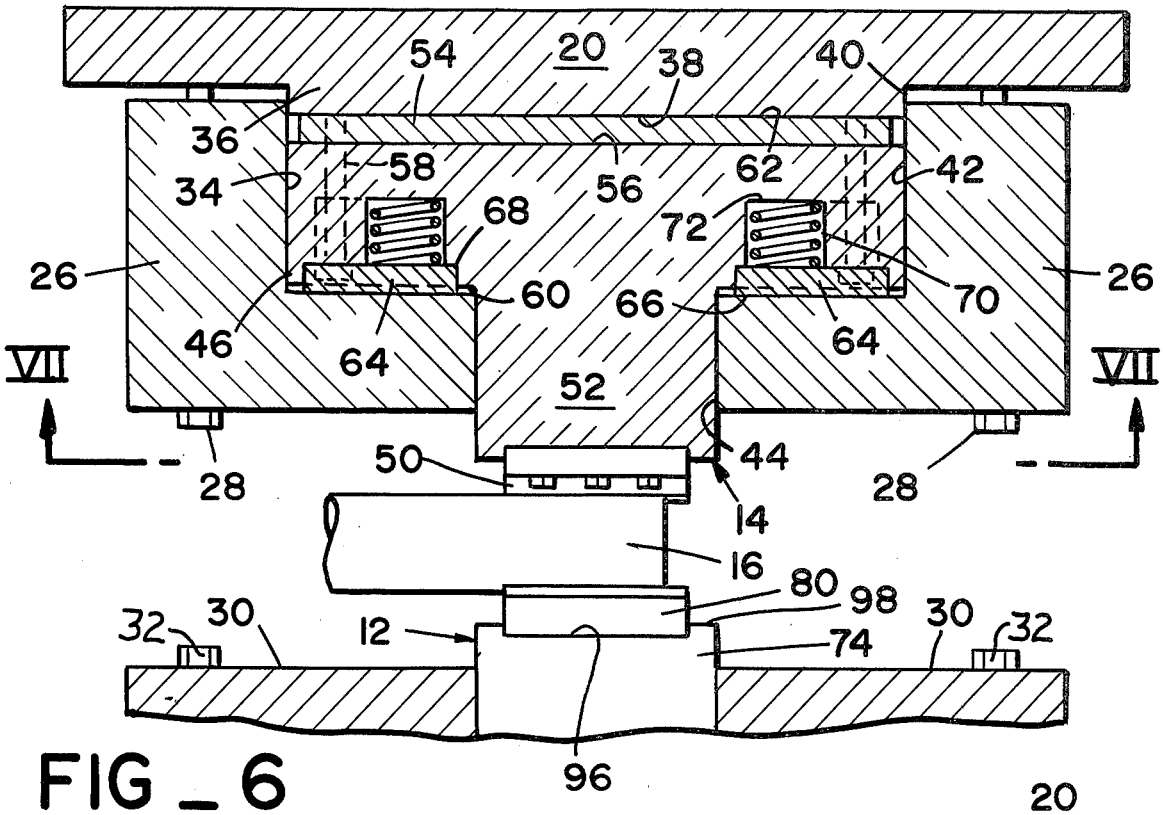
FIG. 6 is a view of the tooth forming machine taken along lines VI—VI of FIG. 5.
Figure 7:
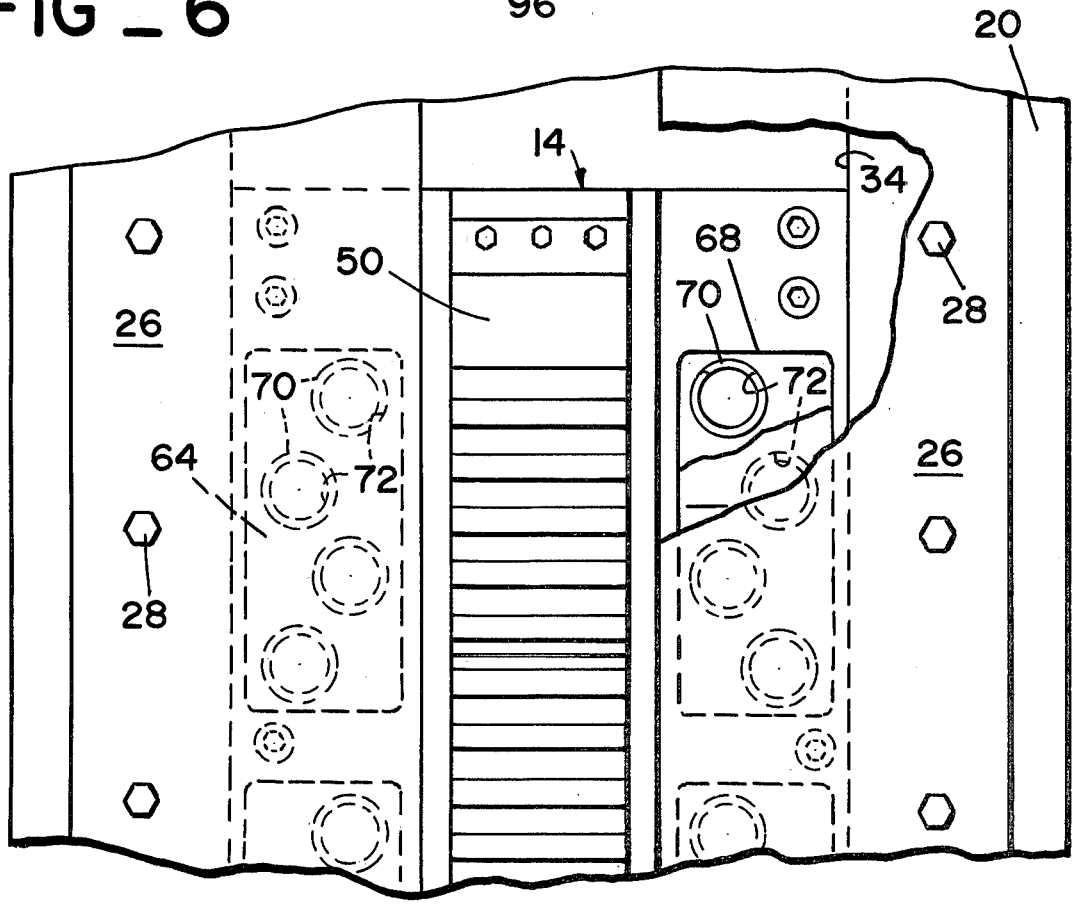
FIG. 7 is a view taken along lines VII—VII of FIG. 6.

As shown also in FIGS. 6 and 7, a pair of L-shaped upper keeper bars 26 with their legs inwardly disposed are secured to the elongated upper bed plate 20 through a plurality of upwardly-extended bolts 28. In a similar manner, a pair of L-shaped lower keeper bars 30 are secured to the lower bed plate 18 through a plurality of elongated retaining bolts 32. Each pair of keeper bars and corresponding bed plates defines a similar, but oppositely oriented, T-shaped cavity shown generally by reference numeral 34, only the upper one of which will be hereinafter described in detail.

As shown in FIG. 6, the upper bed plate 20 has a depending land 36 having a bottom guide surface 38 and side surface 40. The keeper bars 26 have inwardly disposed upper side surfaces 42 in contact with the surface 40 on the bed plate and a pair of inwardly disposed lower side surfaces 44. A pair of upper ledge or guide surfaces 46 on the keeper bars 26 cooperate with the surfaces 42, 44 and the surface 38 of the bed plate to define the upper T-shaped cavity 34.

The upper tool assembly 14 includes a tooth forming die or rack assembly 50, a powered slide member 52, and a bearing plate 54 which is removably secured to a top surface 56 of the slide member by a plurality of bolts 58. The bolts 58 are countersunk into a ledge surface 60 of the slide member, and the slide bearing 54 has an upper surface 62 which is in facing, sliding engagement with the surface 38 of the upper bed plate.

The powered slide member 52 which may weigh as much as approximately 1,500 lbs. for some of the larger spline rolling applications, rests on the upper ledge surfaces 46 of the keeper bars 26 through a plurality of intermediate bearing plates or shoes 64 having a lower surface 66. As noted in both FIGS. 6 and 7, each of the bearing shoes 64 is disposed in a downwardly facing pocket 68 and is biased by a plurality of coil springs 70 contained within a corresponding plurality of depending cylindrical cavities 72 in the slide member.

While a full transverse section of the lower tool assembly 12 is not shown, it includes lower keeper bars 30 and a lower slide member 74 which are similar to the upper section. The lower tool assembly is different, however, in that it is movable on only a lower slide bearing 76 with respect to an upper surface 78 of the bed plate 18, as shown in FIG. 5. The lower slide bearing is removably secured to the underside of the lower slide member by a plurality of retaining bolts 79.

The bearing shoes 64 and the upper and lower slide bearings 54 and 76 are preferably of bronze to withstand the high unit loading encountered. Additionally, a lubrication system (not shown) introduces lubricant into the stationary member of the machine, such as at the upper bed plate 20 and the upper keeper bars 26, so that the associated guide surfaces 38 and 46 are lubricated to minimize relative wear between the sliding surfaces.

The lower tool assembly 12, including a lower tooth forming die or rack assembly 80 and a lower slide member 74, is transversely and tangentially moved with respect to the workpiece 16 by an actuating cylinder system shown generally at 82 and having a cylinder portion 84 and an extendible piston rod 86 secured to a bracket 88. The bracket 88 and a counterpart bracket 90 at the rightward end of the rack are removably secured to the lower slide member by a plurality of bolts 92, 94, respectively. The brackets 88 and 90 further serves to longitudinally retain the lower tooth forming rack in a longitudinal groove 96 defined within an upper surface 98 of the slide member 74 as shown also in FIG. 6.

The upper tool assembly 14 also includes an actuating cylinder system (not shown) connected thereto in a similar manner. These powered actuating cylinder systems are effective to move the upper and lower tool assemblies simultaneously in opposite directions as is described , for example, in the above-mentioned U.S. Pat. No. 3,015,243 to J.C. Drader.

Both the rack assemblies 50 and 80 of the subject invention have a discreet series of orderly steps in the tooth configuration.

A first roughing section of the rack assembly die 80 is shown generally at 100. The first roughing section 100 has a length equivalent to half of the rolling circumference of the workpiece 16, or a whole multiple thereof.

A second roughing section of the rack die 80, indicated generally by the reference numeral 106, has a length similar to that of the first roughing section 100. The second roughing section includes a plurality of teeth 108 providing an additional penetration into the workpiece of approximately 25%, for example, or a cumulative penetration of 75%. While both the tips and roots of the teeth 108 exhibit substantially increased curvature, the amount of additional penetration has been appreciably reduced.

A third roughing section, indicated generally by the reference numeral 110, has a plurality of teeth 112 providing an additional penetration into the workpiece of approximately 12.5% or a cumulative penetration of approximately 87.5%.

A fourth roughing section, indicated generally by the reference numeral 114, includes a plurality of teeth 16 providing an additional penetration of the order of 10.5% of the total finish tooth penetration.

The amount of penetration for each roughing section and the number of roughing sections may be varied to accomodate the depth of finished tooth form desired and to further increase the fatigue life of the present invention.

Lastly, a finishing section indicated generally by the reference numeral 118, and including a plurality of teeth 120, serves to substantially complete the total penetration by an additional finishing penetration of approximately 2%. Finishing section 118 has a length preferably two times or more in even multiples of half the rolling circumference of the workpiece so that a relatively smooth, or coining type finish can be applied to the final teeth formed on the workpiece. The relatively straight-sided teeth 120 provide a finished involute type of spline on the periphery of the workpiece through a generated deformation action. It is to be understood that while this disclosure talks in terms of a particular number of sections, the actual number depends upon their penetration rate and the workpiece to be used.

The upper tooth forming rack assembly or die 50 is identical in profile to the lower rack assembly or die 80 so that the workpiece teeth are diametrically and simultaneously formed by similar stepped teeth by both dies. With both racks, the curvature of the tooth tips and tooth roots should be set such as to produce the desired tooth form on the workpiece. The quantity of teeth in each insert section should be set as a minimum equal to one-half the number of teeth to be formed on the workpiece. The tooth spacing of the inserts should be compatible to the tooth spacing of the workpiece at the rolling pitch diameter. The length of the insert sections should be such that its ends are precisely on the centerline of the tooth space so that the tooth spacing will remain consistent throughout the rack assembly and produce the desired spacing on the resultant workpiece.

As seen in FIG. 1, the rack assembly 80 is comprised of a generally elongated insert holder 121, having a planar bond surface 122. Extending from opposite ends of insert member 121 are flanges 124, 126, the purpose of which is to enable mounting of the rack assembly in the tooth forming machine.

Figure 2:
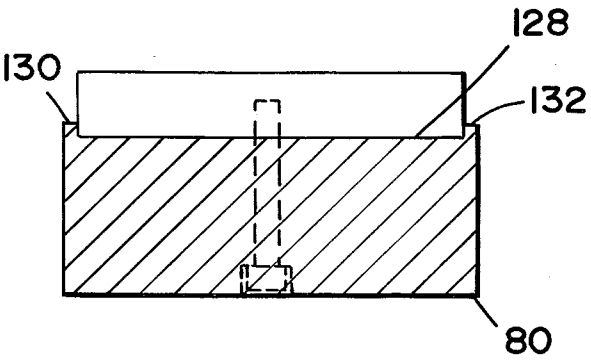
FIG. 2 is a cross-sectional view of the same taken along lines II—II in FIG. 1.

As seen in FIG. 2, the generally planar top surface 128 of the insert holder 121 is bordered on the lateral sides, either one or both, thereof by ridges 130, 132 for the purpose of lateral retention of the inserts under the forces of the tooth forming machine. As may be seen in FIG. 1, the insert members are each releasably retained on the insert holder 121 by means of a pair of cap screws threadably secured through the bottom of the insert holder into the bottom of the insert.

For example, in FIG. 1, inserts 110 through 118 are releasably retained to insert holder 121 by means of a plurality of cap screws 134 passing through bores 136 leading from counterbores 138.

Figure 4:
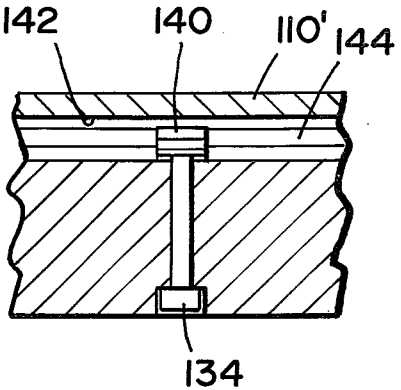
FIG. 4 is a partial-sectional view of the same taken along lines IV—IV in FIG. 3.
Figure 3:
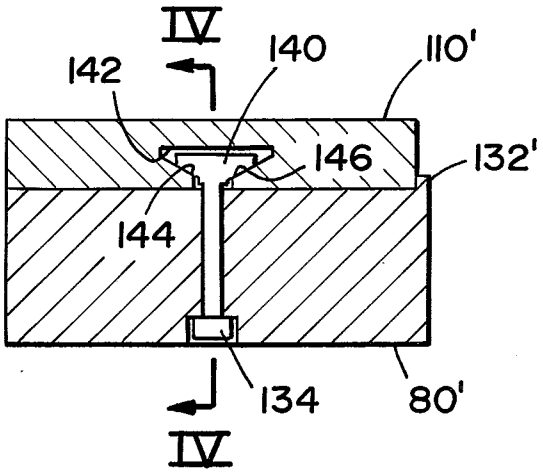
FIG. 3 is a cross-sectional view of an alternate embodiment showing alternate means of securing the inserts to the insert holder.

FIGS. 3 and 4 show an alternate embodiment wherein the cap screws, rather than being threaded into threaded bores in the inserts, are threaded into bores in a T-shaped retainer 140. The T-shaped retainer, in turn, is contained within a longitudinal slot 142 having a pair of tapered surfaces 144, 146. Retainer 140 has a corresponding pair of tapered surfaces for contacting tapered surfaces 144, 146. With the alternate embodiment, only a single lateral side ridge 132' is used for lateral retention.

It is to be understood that the foregoing description is merely illustrative of the preferred embodiment of the invention and that the scope of the invention is not to be limited thereto, but is to be determined by the scope of the appended claims.

What is claimed is:

1. In a tooth forming machine for selectively deforming a rotatably supported cylindrical workpiece, including a housing, a powered member slidably mounted on said housing for movement substantially transversely of such a workpiece, the improvement comprising forming die means mounted on said powered member in tangential tooth forming relation with the periphery of said workpiece including an elongated insert holder defining a top surface and holder mounting means mounting said insert holder on said powered member, a stepped series of descrete tooth forming sections and section mounting means mounting said tooth forming sections on the top surface of said insert holder, and further including a raised flange on said top surface on one end of said tooth forming sections in contacting relation therewith for lateral retention, whereby individual tooth forming sections may be removed and thrown away when worn thereby saving on tooling costs and prolonging the useful life of the forming die means.

2. The invention of claim 1 wherein said section mounting means comprise bolt means releasably securing said tooth forming sections to said insert holder.

3. The invention of claim 2 wherein said bolt means comprise bolts passing through apertures in said insert holder threadably secured in threaded apertures in said tooth forming sections.

4. The invention of claim 1 wherein said insert holder defines a top surface upon which said sections are mounted and further including a pair of raised flanges on said top surface on opposite sides of said section for lateral retention.

5. The invention of claim 1 wherein said sections include an elongated slot therein and wherein said section mounting means comprise retainer means within said slot and cooperable therewith, and bolt means releasably securing said retainer means and thereby said sections to said insert member.

6. The invention of claim 5 wherein said slot includes tapered surfaces and wherein said retainer means comprise bolt retainers having correspondingly tapered surfaces.

7. The invention of claim 6 wherein said bolt means comprise bolts passing through apertures in said insert holder threadably secured in threaded apertures in said bolt retainers.

8. The invention of claim 1 wherein the material of said tooth forming section is relatively harder than the material of said insert holder.

9. The invention of claim 1 further including a second raised flange on said top surface on the end of said tooth forming sections opposite to said one end and in contacting relation therewith so as to confine said tooth forming sections between said raised flanges.

10. The invention of claim 9 wherein said flanges are of integral, one-piece construction with said tool holder and wherein said mounting means mounting said insert holder on said powered member comprises flanges extending from opposite ends of said insert holder.

* * * * *